United States Patent [19]

Meyer et al.

[11] Patent Number: 4,655,982

[45] Date of Patent: Apr. 7, 1987

[54] METHOD FOR THE CONTINUOUS PRODUCTION OF PLATES OF FIBRE REINFORCED CONCRETE

[75] Inventors: Adolf Meyer, Leimen-Lingental; Helmut Steinegger, Leimen; Ulrich Pachow, Neubeuern; Manfred Pfeifer, Zuzenhausen, all of Fed. Rep. of Germany

[73] Assignee: Heidelberger Zement AG, Heidelberg, Fed. Rep. of Germany

[21] Appl. No.: 763,183

[22] Filed: Aug. 7, 1985

[30] Foreign Application Priority Data

Aug. 24, 1984 [DE] Fed. Rep. of Germany ..... 3431143

[51] Int. Cl.[4] ..... B28B 1/10; B28B 1/52; B28B 5/02; B28B 11/00

[52] U.S. Cl. ..... 264/166; 264/70; 264/131; 264/136; 264/171; 264/256; 264/257; 264/333; 425/115

[58] Field of Search ..... 264/333, 131, 256, 257, 264/70, 136, 166, 171; 425/115

[56] References Cited

U.S. PATENT DOCUMENTS

| | | | |
|---|---|---|---|
| 4,265,979 | 5/1981 | Baehr et al. | 264/333 X |
| 4,362,675 | 12/1982 | Shannon | 264/333 X |
| 4,414,262 | 11/1983 | Hartmann et al. | 264/333 X |
| 4,450,128 | 5/1984 | Takeuchi | 264/256 X |

*Primary Examiner*—Donald Czaja
*Assistant Examiner*—Harold Pyon
*Attorney, Agent, or Firm*—Kurt Kelman

[57] ABSTRACT

A method for the continuous production of plates and-/or shaped bodies of fibre reinforced hydraulic setting masses is described in which the mass is provided in a predetermined thickness over the entire width of the plate to be produced, on a substrate continuously moved by a belt. Fibre cuttings from a cutting device are dispersed in a desired distribution onto the surface of the mass moving with the substrate and these are subsequently incorporated into the mass by a tool acting uniformly over the entire width of the mass. The raw plate can be further processed in its still deformable condition and brought into a desired final shape.

18 Claims, No Drawings

METHOD FOR THE CONTINUOUS PRODUCTION OF PLATES OF FIBRE REINFORCED CONCRETE

The invention relates to a method for the continuous production of plates and/or shaped bodies of fibre reinforced hydraulic setting masses.

The production of plates and shaped bodies of fibre reinforced concrete poses considerable difficulties and maufacturing problems. With frequently used spraying methods for such fibre reinforced masses it is more particularly extremely difficult to achieve a uniformly thick plate with a desired, not necessarily homogeneous fibre distribution. Additionally, it happens that on moulding and shaping the raw plate, the hydraulic setting mass adheres to the surface of a mould, so that it is then not possible to achieve faultless moulding and releasing.

It is an object of the invention to provide a method of the above-mentioned kind with which in a continuous manner a faultless fibre reinforced uniformly thick plate with desired fibre amount, fibre distribution and/or fibre orientation, can be produced, as well as shaped bodies formed therefrom with uniformly smooth and, if desired, with enhanced surfaces.

This object is solved by a method of the above-mentioned kind in which the hydraulic setting mass is provided in a predetermined thickness on a substrate which lies on a belt and is moved with the belt, fibre cuttings coming from a cutting mechanism are distributed in dosed quantity on the surface of the continuously moving mass and during the movement are pressed into the matrix and the mass is simultaneously compressed by a tool acting over the entire working breadth.

The advantages of such a method are many. Apart from the fact that operation can be continuous, the hydraulic setting mass can be provided in a uniform thickness over the working breadth and the fibre reinforcement can be incorporated as desired. Furthermore, it is possible to work with a mass which does not have any excess water and consequently does not have to be subject to water removal in a separate working step.

The desired fibre distribution and fibre orientation can be easily controlled and very simply monitored so that a far reaching uniformity of the manufactured plates can be ensured. By using a substrate, a clean, smooth and if desired also coloured and/or textured or profiled plate surface can be formed. It is a particular advantage of the method that by folding the lateral edges of the substrate over the lateral edges of the not yet hardened mass during the manufacturing process, straight lateral edges of the plate can be produced, with rounding off of its corners. In this manner a further edging procedure on the plate can be avoided. The width of the plate is adjustable from the outset within close tolerances and a subsequent straightening of the plate edges which always involves loss of material, is not necessary. The adjustment of the width is effected by adjustable stationary guide elements relative to which the belt moves and which are arranged above the belt at the desired spacing from each other.

The substrate lying on the belt and moving with it serves as a separating layer and also for forming lateral edges of the plate. It can consist of various materials, for example, of a plastics foil a glass fleece or plastics coated paper. Thus, already by means of the substrate many possibilities are given of providing the surface of the plate with a coloured and structured appearance. The substrate may be provided as a formwork and as such faultlessly removed from the plate surface without residue and without any damage. In this manner the plate surface is completely uniform and smooth and does not have any rough regions or flaws. On the other hand it is possible to incorporate the substrate itself and/or its coating of enhancing material, into the plate surface. Accordingly, the surface of a flat plate or the surface of a plate formed in wavy or trapezoidal configuration from the raw plate when in green condition or of other shaped bodies, for example tubes, can be given desired structures.

Moreover, the substrate also forms a protection for the finished plate when stacking and also when transporting. Finally, by use of such a substrate an expensive subsequent treatment which is required in customary methods can be saved since the substrate remaining on the plate is as good as such a subsequent treatment.

The method will be further explained with reference to an embodiment.

On a belt arranged for continuous movement which has guide elements disposed in accordance with the desired width of a plate to be produced, a substrate for receiving the mass is placed. This substrate is preferably wider than the width of the plate to be produced which is predetermined and established by the spacing of the guide elements, so that the lateral edges at the longitudinal sides of the substrate stand up or can be placed over the upper sides of the guide elements. While the substrate is moved forwards with the belt, the hydraulic setting mass is continuously applied to the substrate in a uniform thickness and in a width determined by the spacing of the guide elements. This can for example be effected by extruding the mass through a nozzle, the opening of which corresponds to the width of the plate to be produced. Behind the extruder and above the transport path of the mass, a cutting mechanism is arranged which continuously ejects fibre cuttings of the desired length into a gravity chute from which the fibre cuttings are then dispersed in an oriented manner onto the surface of the mass. Since the mass is continuously moving below the shower of cuttings, the fibre cuttings coming from the gravity chute are controllably distributed uniformly on the surface of the mass.

In a further station the fibre cuttings are pressed into or incorporated in the surface of the mass with the aid of a tool which acts over the entire width of the surface. The depth of incorporation can be adjusted by adjusting the tool and thus the fibre distribution in the cross section of the plate can be selected according to requirements. Simultaneously, the fibre cuttings are wetted and the mass is compressed. Advantageously, a resiliently yieldable tool is used.

The step of fibre incorporation can be repeated a plurality of times in the same layer of the mass provided on the substrate or in subsequently applied layers. In addition to the reinforcing by fibre cuttings, endless filaments may be applied to and/or incorporated in the mass of the plate to be produced. The endless filaments may be impregnated in known manner.

Since, as explained, the substrate is wider than the plate to be formed, and the parts of the substrate extending bilaterally beyond the plate are drawn upwardly and thereby cover the plate edges, the outer sides of these parts of the substrate slide on the guide elements. This prevents rubbing and lateral binding of the mass on the guide elements. By folding the projecting parts of the substrate over the side edges of the raw plate, they can be cleanly rounded off.

Cement can be distributed on the upper surface of the finished raw plate and/or a covering, for example a fleece which remains bonded to the plate or a removable foil, can be provided.

The method according to the invention allows the processing of the outer surface of the finished plate already during the manufacturing procedure, for example colouring or profiling and/or enhancing and/or improving the properties in any other manner. This can be effected by placing on to the free side of the substrate a releasable coloured layer, a profiled band or other material suitable for the enhancement. The layer of colour or of other material is incorporated in the moist hydraulic setting mass extruded on the substrate, or the profiling of a profile band is pressed into the mass so that the finished plate surface is coloured, profiled or otherwise enhanced. Thus a subsequent treatment of the plate surface is not necessary.

By the method according to the invention, surprisingly it is possible to work with a fibre reinforced hydraulic setting mass without excess water. The raw plate is either left to finally harden as a flat plate or is placed into an appropriate shaping device for shaping.

In order to facilitate the incorporation of the fibres and the shaping step, additives may be used to optimise the consistency and coherency. The mass can be additionally modified by vibration, for the incorporation of the fibres and for the shaping.

The opening up of the fibres can be effected by appropriate shaping of the gravity chute and/or by structures in the gravity chute, which latter may be stationary or driven. The desired orientation of the fibres is more particularly changed by dimensioning the gravity chute opening in accordance with the fibre length.

The resiliently yieldable tool serving for gentle incorporation of fibres into the mass, can engage in the mass with a plurality of parallel cutters, and the desired spring force can be applied by the inherent elasticity of a material used for its manufacture.

I claim:

1. A method for the continuous production of a shaped body of a fibre-reinforced hydraulically setting mass, comprising the consecutive steps of (a) continuously moving a substrate on a continuously moving belt, (b) applying a continuously moving layer of a predetermined thickness of the hydraulically setting mass on the continuously moving substrate, the layer having a width defined between two lateral edges, (c) cutting fibres into a multiplicity of fibre cuttings and distributing the fibre cuttings in a dosed quantity over the surface of the continuously moving layer of the hydraulically setting mass, (d) working and pressing the distributed fibre cuttings into the mass with a tool extending over the entire width of the layer and simultaneously compressing the mass while the layer of the hydraulically setting mass continuously moves, and (e) permitting the mass to set until the shaped body is produced.

2. The method of claim 1, wherein a plurality of parallel cutter blades of the tool penetrate into the mass to work and press the fibre cuttings thereinto.

3. The method of claim 1, wherein the tool exerts a resiliently yieldable force to work and press the fibre cuttings into the mass.

4. The method of claim 3, wherein the tool is made of an elastic material providing the resiliently yieldable force.

5. The method of claim 1, wherein the fibre cuttings are distributed by gravity through a chute.

6. The method of claim 5, wherein the chute has an output opening dimensioned to conform to the length of the fibre cuttings whereby the fibre cuttings are oriented while being distributed over the surface of the layer of the hydraulically setting mass.

7. The method of claim 5, wherein the fibre cuttings are disentangled in the chute by built-in structural members.

8. The method of claim 1, comprising the further step of applying endless rovings on the surface of the layer of the hydraulically setting mass.

9. The method of claim 1, comprising the further step of incorporating endless rovings in the layer of the hydraulically setting mass.

10. The method of claim 1, wherein the mass has a water content essentially just sufficient for hydration of the mass.

11. The method of claim 1, wherein the layer of the hydraulically setting mass is applied to the surface of the substrate in the predetermined thickness by extrusion.

12. The method of claim 1, wherein the fibre cuttings are distributed, worked and pressed into the mass in successive stages.

13. The method of claim 1, wherein a succession of said layers wherein the fibre cuttings are worked and pressed are applied on the continuously moving substrate and upon each other.

14. The method of claim 1, wherein the substrate has a width defined between two lateral edges and exceeding that of the layer of the hydraulically setting mass, comprising the further step of folding the lateral edges of the substrate over the lateral edges of the layer of the hydraulically setting mass.

15. The method of claim 1, comprising the further step of applying a covering over the layer of the hydraulically setting mass whereinto the fibre cuttings have been worked and pressed before the mass is permitted to set.

16. The method of claim 14, wherein cement is sprinkled over the layer to apply said covering.

17. The method of claim 1, comprising the further step of applying a layer of a finishing material to the substrate before the layer of the hydraulically setting mass is applied thereto, the finishing material being separable from the substrate and integrable in a surface of the hydraulically setting mass opposite the surface over which the fibre cuttings are distributed and facing the substrate for applying a finish to the opposite surface.

18. The method of claim 1, wherein the hydraulically setting mass whereinto the fibre cuttings have been worked and pressed is shaped before the mass is permitted to set.

* * * * *